US005947838A

United States Patent [19]

Tkacs

[11] Patent Number: 5,947,838

[45] Date of Patent: Sep. 7, 1999

[54] GOLF CLUB AND SHAFT FOR IMPROVED GOLF SWING

[76] Inventor: Stephen G. Tkacs, 5 Plum Tree La., Coventry, R.I. 02816

[21] Appl. No.: 08/888,111

[22] Filed: Jul. 3, 1997

[51] Int. Cl.[6] ..... A63B 53/10

[52] U.S. Cl. ..... 473/314; 473/316

[58] Field of Search ..... 473/219, 251, 473/282, 313, 314, 305, 311, 300, 316, 317

[56] References Cited

U.S. PATENT DOCUMENTS

| | | | |
|---|---|---|---|
| 1,116,417 | 11/1914 | Hackbarth . | |
| 1,171,806 | 2/1916 | Scott . | |
| 1,480,961 | 1/1924 | Smith . | |
| 1,768,378 | 6/1930 | Smith . | |
| 2,146,321 | 2/1939 | Wettlaufer | 473/306 |
| 4,319,750 | 3/1982 | Roy . | |
| 4,361,325 | 11/1982 | Jansen | 273/DIG. 2 |
| 4,423,873 | 1/1984 | Shiratori . | |
| 4,506,888 | 3/1985 | Nardozzi | 473/307 |
| 4,537,403 | 8/1985 | Farina | 473/203 |
| 4,569,525 | 2/1986 | Folger . | |
| 4,679,791 | 7/1987 | Hull . | |
| 4,869,507 | 9/1989 | Sahm . | |
| 5,577,726 | 11/1996 | Fenton | 473/305 |
| 5,711,719 | 1/1998 | Fireman | 473/251 |

*Primary Examiner*—Sebastiano Passaniti

[57] ABSTRACT

A golf club is provided with a shaft that has a rectangular cross-section. The rectangular cross-section substantially restricts the movement of the golf club head to a direction parallel to the swing. The grip on the shaft also has a rectangular cross-section to guide the golfer's hands, thus providing a more consistent grip. The head of the golf club has a rectangular block shape for improved aerodynamics and a larger surface area on the club face for contact with the ball.

3 Claims, 1 Drawing Sheet

GOLF CLUB AND SHAFT FOR IMPROVED GOLF SWING

BACKGROUND OF THE INVENTION

The sport of golf is enjoyed by professionals and amateurs alike. The sport comprises a plurality of holes, usually nine or eighteen, on an area of landscaped land with a series of obstacles, such as water and sand traps. The object of each hole is to hit the golf ball with one or a plurality of golf clubs from the starting point, the tee, into the hole using as few strokes as possible. The first stroke on each hole is the tee-off, which is the initial attempt to hit the ball as close to the hole as possible. This done by trying to hit the ball with maximum distance and accuracy. Much of this effort on the initial stroke or drive is concentrated on the physical technique of the golfer. The golfer attempts to swing the head of the golf club with speed and control to transfer the momentum of the head of the golf club to the golf ball. The golf club itself is designed to maximize the momentum transferred to the ball. The club used to drive the ball is called the driver or "wood." This club is designed with a thin shaft and a large wooden head.

The shaft is conventionally made up of a flexible material, such as a composite material. The weight of the wooden head causes the shaft to bend. This phenomenon is called "waggle." However, the club is not always swung perfectly straight, especially considering the rotation of the golfer's hands on the grip of the golf club. This causes the waggle in the shaft to affect the movement of the golf club head.

SUMMARY OF THE INVENTION

It is an object of the present invention to provide an improved golf club which restricts the movement of the golf club head.

It is a further object of the invention to provide a golf club that has a rectangular cross-section which restricts waggle to two directions. It is a further object of the invention to provide a grip on the golf club which also has a rectangular cross-section consistent with the shaft, thus providing a clear and consistent grip and guide for the golfer's hands.

It is a still further object of the invention to provide a golf club with a head that has a rectangular block shape for improved aerodynamics and surface area for contact with the golf ball.

DESCRIPTION OF THE PREFERRED EMBODIMENTS

Figure 1:
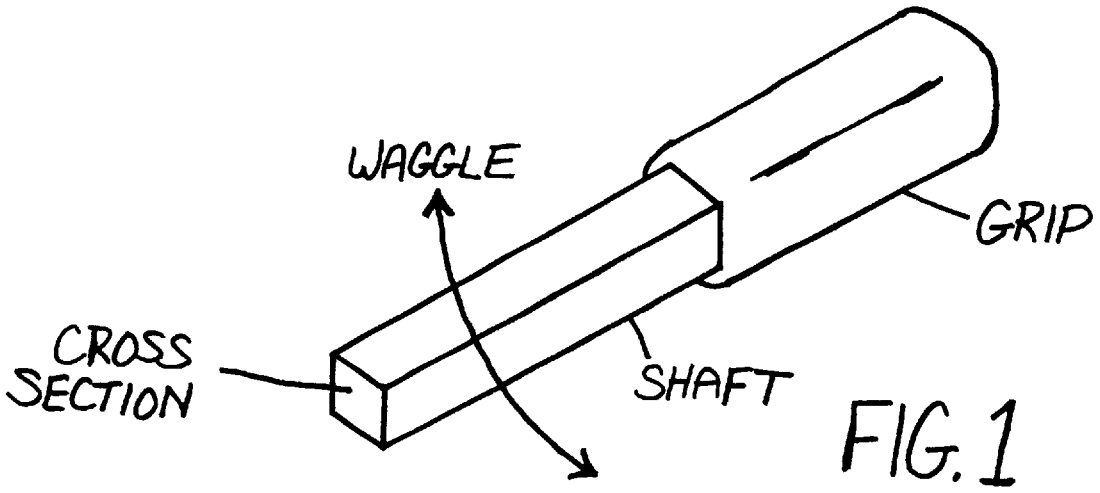
FIG. 1 is an illustration of a cross-section of the shaft and a handle with grip of the golf club of the present invention.

In a first embodiment of the present invention, a golf club is provided with a rectangular shaft and grip. The shaft extends between the grip and the club head and can be made of a flexible material, such as a composite material. Referring to FIG. 1, a rectangular cross-section of the shaft of the golf club is shown. As can be seen in FIG. 1, the grip on the shaft also has a rectangular cross-section. This allows the golfer to use the edges of the grip to guide the golfers hands to provide a consistent grip.

Figure 2:
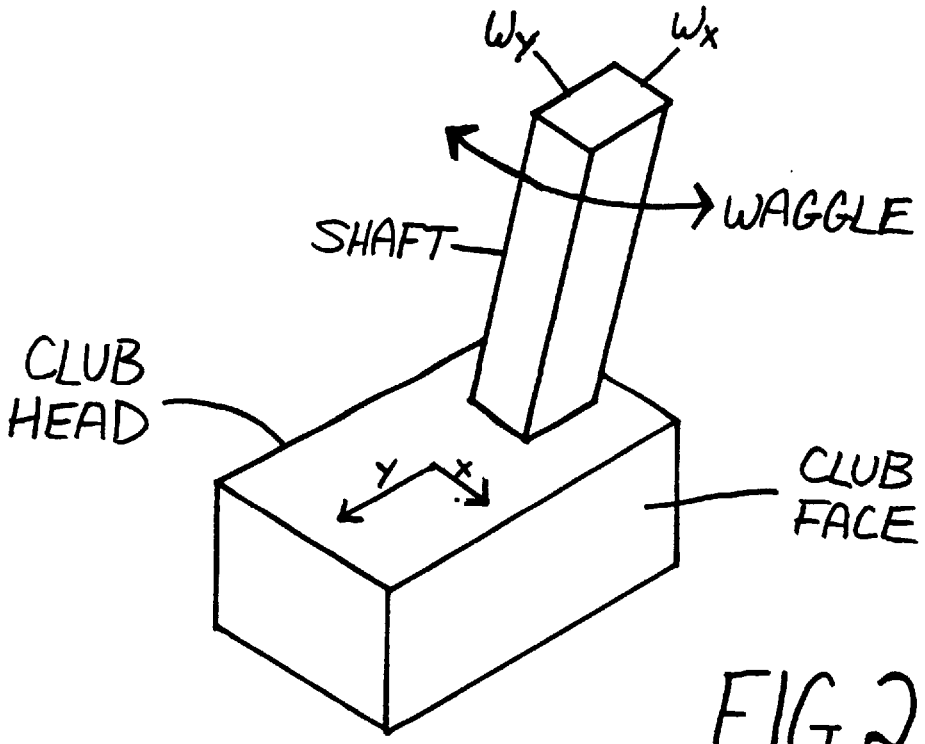
FIG. 2 is an illustration of the rectangular block shaped head of the golf club of the present invention.

With reference to FIG. 2, the head of the golf club of the present invention is shown. As can be seen in FIG. 2, the shaft has a rectangular cross-section. FIG. 2 also illustrates an x-axis parallel to one face of the shaft and a y-axis parallel to another face of the shaft. The direction of the x-axis is the direction of the movement of the golf club head. The direction of the y-axis is perpendicular to and opposes the direction of the movement of the golf club head. The rectangular shape of the cross-section of the shaft restricts waggle to the x-axis and the y-axis. However, because the golf club head predominantly moves in the direction of the x-axis, waggle will be substantially limited to this direction. To further limit waggle to the x-axis, the width ($w_x$) of the shaft in the direction of the x-axis can be made to be comparatively less than the width ($w_y$) of the shaft in the direction of the y-axis.

Further with respect to FIG. 2, the head of the golf club is shown to be of a rectangular block shape. The top and bottom surfaces of the club head are parallel to the direction of the movement of the club head and channel the air to provide more control. The club face also has a relatively large surface area for contact with the golf ball. The rectangular cross-section of the shaft results in the shaft being less flexible. This allows for more weight in the club head, thus resulting in more momentum being transferred to the golf ball.

The golf club described above with respect to the preferred embodiments is a driver or "wood" type golf club. However, one skilled in the art will recognize that the present invention can be used with any golf club or other instrument that is swung or rotates. One skilled in the art will recognize that the shape of the cross-section of the shaft and grip can be rounded or oval in shape. Thus the invention should not be construed to be limited to the preferred embodiments described above, and the only limitations to the invention are as set forth in the following claims.

I claim:

1. A golf club comprising:

a club head for striking a golf ball;

a grip; and, shaft means comprising a shaft, being made up of a flexible material, extending between said club head and said grip for restricting the flexibility of said shaft to two directions, said shaft having a generally rectangular cross-section;

wherein the golf club is a driver;

wherein said shaft means has two faces which are parallel to the movement of the club head during a swing and two faces which are perpendicular to the movement of the club head during said swing; and, wherein the width of the faces that are parallel to the movement of the club head during said swing is less than the width of the faces that are perpendicular to the movement of the club head during said swing, whereby said shaft is arranged such that the rectangular cross-section substantially limits waggle of the shaft to a direction generally parallel to the movement of the clubhead during a swing.

2. A golf club comprising:

a club head for striking a golf ball;

a grip; and, shaft means comprising a shaft, being made up of a flexible material, extending between said club head and said grip for restricting the flexibility of said shaft to two directions, said shaft having a generally rectangular cross-section;

wherein the golf club is a driver; and, wherein the club head has a rectangular block shape, whereby said shaft is arranged such that the rectangular cross-section substantially limits waggle of the shaft to a direction generally parallel to the movement of the clubhead during a swing.

3. A golf club comprising:

a club head for striking a golf ball;

a grip; and, shaft means comprising a shaft, being made up of a flexible material, extending between said club head and said grip for restricting the flexibility of said shaft to two directions;

wherein said golf club is a driver and said shaft means and said grip have a generally rectangular cross-section, whereby said shaft is arranged such that the rectangular cross-section substantially limits waggle of the shaft to a direction generally parallel to the movement of the clubhead during a swing.

* * * * *